US005275673A

United States Patent [19]

Suzuki et al.

[11] Patent Number: 5,275,673

[45] Date of Patent: Jan. 4, 1994

[54] METHOD OF AND APPARATUS FOR CONNECTING A PAPER WEB THREADING MEMBER WITH A PAPER WEB

[75] Inventors: Kunio Suzuki, Kanagawa; Kazuaki Shibuya, Tokyo, both of Japan

[73] Assignee: Kabushiki Kaisha Tokyo Kikai Seisakusho, Japan

[21] Appl. No.: 861,590

[22] Filed: Apr. 1, 1992

[30] Foreign Application Priority Data

Apr. 11, 1991 [JP] Japan ..... 3-105212

[51] Int. Cl.[5] ..... B41F 13/02

[52] U.S. Cl. ..... 156/64; 101/227; 156/502; 156/510; 156/519; 242/58.1; 242/58.5

[58] Field of Search ..... 156/64, 502, 504, 510, 156/519; 101/227, 228, 226; 242/58.1, 58.5

[56] References Cited

U.S. PATENT DOCUMENTS 4,063,505 12/1977 Sasamoto et al. ..... 101/228
5,052,295 10/1991 Suzuki et al. .

FOREIGN PATENT DOCUMENTS 0355026 2/1990 European Pat. Off. .
0418903 3/1991 European Pat. Off. .

*Primary Examiner*—David A. Simmons
*Assistant Examiner*—William J. Matney, Jr.
*Attorney, Agent, or Firm*—Ronald P. Kananen

[57] ABSTRACT

This invention provides a method of and an apparatus for sticking a paper web to a paper web threading member superposed on the paper web through the intermediary of an adhesive material. The apparatus comprises a paper web threading member moving device (1) for moving the paper web threading member to a predetermined position where a paper web engaging member (La1) secured to the paper web threading member (La) is stuck to a paper web and/or moving it from that position along a predetermined path; a detector device (2) for detecting the presence of paper web threading member and outputting a signal; a paper web moving device (3); a detector device (4) for detecting movement of the paper web (W) to the predetermined position where the paper web is stuck to the paper web engaging means and outputting a signal; and an adhesive material applying device (5) provided near the predetermined position for applying an adhesive material onto the paper web engaging member and the paper web to connect the paper web threading member located at the predetermined position with the paper web.

6 Claims, 5 Drawing Sheets

METHOD OF AND APPARATUS FOR CONNECTING A PAPER WEB THREADING MEMBER WITH A PAPER WEB

BACKGROUND OF THE INVENTION

1. Field of the Invention

This invention relates to a method of and apparatus for sticking a paper web threading member to a paper web in a paper web threading operation wherein a paper web is threaded along a predetermined path in a paper web handling machine such as a rotary printing machine or the like through the intermediary of the paper web threading member adapted to be moved along the predetermined path, and more particularly, to a method of and apparatus for sticking a paper web to a paper web threading member superposed on the paper web through the intermediary of an adhesive material such as an adhesive tape or the like.

2. Description of the Prior Art

As a prior art arrangement, there is an apparatus for sticking one of the two paper webs obtained by division of a paper web in two portions on the way of a predetermined paper web threading path in the longitudinal direction to a paper web engaging member connected to a paper web threading member which stands by on the downstream side of the position where the paper web is divided, as disclosed in Laid-open Publication No. Hei 2-29727 of Japanese Utility Model Registration Application.

In this apparatus, with continued threading of the other one of the two divided paper webs through a relevant path, one of the paper webs is sent to a position where it is stuck to a paper web engaging member which stands by. When one of the paper webs arrives at a predetermined position, a detector means detects the arrival thereof and renders an adhesive applying means operative. The adhesive applying means holds an adhesive material and, when rendered operative, serves to bring one end of the adhesive material into contact with the paper web engaging member and apply it to the latter, and at the same time press the paper web engaging member and one of the paper webs in superposed condition. Immediately thereafter, the paper web threading member is moved together with one of the paper webs along the predetermined paper web threading path at substantially the same speed as the feeding speed of one of the paper webs so as not to prevent one of the paper webs from being fed into the paper web threading path. The arrangement is made such that this movement causes the adhesive material whose one end is applied to the paper web engaging member to be drawn out and applied onto and over the paper web engaging member and one of the paper webs, thereby connecting both of them.

Hereupon, threading of a paper web through a paper web handling machine is conducted only before processing operation such as printing by the machine is effected, or when an accident such as severing of a paper web occurs during the processing operation. And, the above-mentioned prior art apparatus is arranged such that in case a paper web threading operation is conducted a series of operations for sticking a paper web to the paper web engaging member are made continuously after the paper web arrives at a predetermined position where it is stuck to the paper web engaging member.

However, since the adhesive material for sticking a paper web to the paper web engaging member is held on an adhesive applying device in such a condition as the adhesive surface on one end of the adhesive material is always exposed to the outside air, and also since during the paper web handling operation paper dust scattered by the paper web which is running adheres to the adhesive surface or the quality of the adhesive surface is deteriorated by drying, the adhesive force thereof is deteriorated in most cases. Therefore, even if the above-mentioned series of operations are commenced after the arrival of the paper web at the predetermined position, because the time during which one end of the adhesive material is pressed against the paper web engaging member is extremely short, one end of the adhesive material is not applied to the paper web engaging member so that the paper web cannot be stuck to the paper web engaging member, thus making it impossible to thread the paper web through the predetermined path using the paper web threading member.

SUMMARY OF THE INVENTION

This invention has been made in view of the above-mentioned problems in the prior art, and has for its object to provide a method of and an apparatus for connecting a paper web threading member to a paper web wherein in conducting a paper web threading operation when a paper web engaging member connected to one end of the paper web threading member is stuck to the paper web by an adhesive material one end of the adhesive material can be applied with certainty to the paper web engaging member with the result that the paper web can be stuck satisfactorily to the paper web engaging member to thereby enable the paper web to be threaded along a predetermined path using the paper web threading member.

To achieve the above-mentioned object, according to a first aspect of the present invention, there is provided a method of connecting a paper web threading member with a paper web comprising the steps of applying one end of an adhesive material to a paper web engaging member connected to one end of the paper web threading member, and then letting them stand by in that condition, moving the paper web by a predetermined distance along a paper web threading path towards the downstream side thereof so that it may overlap the paper web engaging member which stands by, and moving again the paper web engaging member and the paper web together along the paper web threading path towards the downstream side thereof while pressing against both of them so that the succeeding portion of the adhesive material may be applied onto the paper web engaging member and the paper web after the paper web has overlapped the paper web engaging member which stands by.

Further, according to a second aspect of the present invention, there is provided an apparatus for connecting a paper web threading member with a paper web comprising: a paper web threading member moving means for moving the paper web threading member to a predetermined position where a paper web engaging member connected to one end of the paper web threading member is stuck to the paper web and/or moving the paper web threading member from the predetermined position along a predetermined path; a paper web threading member detector means for detecting that the paper web threading member is located at the predetermined position or that it has been moved away therefrom, and then outputting a signal; a paper web moving means for moving the paper web; a paper web detector means for detecting the movement of the paper web to the predetermined position where the paper web is stuck to the paper web engaging member, and then outputting a signal; and an adhesive material applying means provided in the vicinity of the predetermined position for applying an adhesive material onto the paper web engaging member and paper web to connect the paper web threading member located at the predetermined position with the paper web.

The present invention incorporating the above-mentioned aspects has the following advantages.

In brief, according to the present invention, the paper web threading member can be stuck with certainty with a paper web, and as a result, it has become possible to thread the paper web smoothly along a predetermined paper web threading path using the paper web threading member. Consequently, it is unnecessary to spend more labor than that is required for making preparation before operation of the paper web handling machine, which contributes to a considerable manpower saving. Further, in the event of severing of paper web during operation of the paper web handling machine, quick and smooth restoration can be made, which contributes, together with the above-mentioned labor saving for making preparation before operation, to improvement in the operational efficiency of the paper web handling machine.

The above-mentioned and other objects, aspects and advantages of the present invention will become apparent to those skilled in the art by making reference to the following detailed description and the accompanying drawings in which a preferred embodiment incorporating the principles of the present invention is shown by way of example only.

BRIEF DESCRIPTION OF THE DRAWINGS

FIGS. 2 to 9 are schematic, side elevational views of principal parts showing the operation of the embodiment of the present invention, wherein FIG. 2 shows a condition wherein a paper web threading member is located at a predetermined position; FIG. 3 shows a condition wherein an adhesive material supply mechanism and a pressing mechanism have been advanced to the predetermined position; FIG. 4 shows a condition wherein the adhesive material supply mechanism and the pressing mechanism have been returned to their respective original positions; FIG. 5 shows a condition wherein a paper web is moving towards the downstream side, while it is being divided by the action of a slitter into two portions in the longitudinal direction thereof; FIG. 6 shows a condition wherein a paper web engaging member connected to one end of the paper web threading member and one of the divided paper webs are pressed between an adhesive material holding roller, round which the adhesive material is partially wound, and an endless belt; FIG. 7 shows a condition wherein the adhesive material is applied onto the divided paper web so that it extends in the longitudinal direction thereof; FIG. 8 shows a condition wherein the adhesive material of a predetermined length applied, onto the divided paper web is cut; and FIG. 9 shows a condition wherein the operation of connecting the paper web threading member with the paper web has been completed.

DETAILED DESCRIPTION OF A PREFERRED EMBODIMENT

A preferred embodiment of the present invention will now be described in detail below with a reference to the accompanying drawings.

Figure 1:
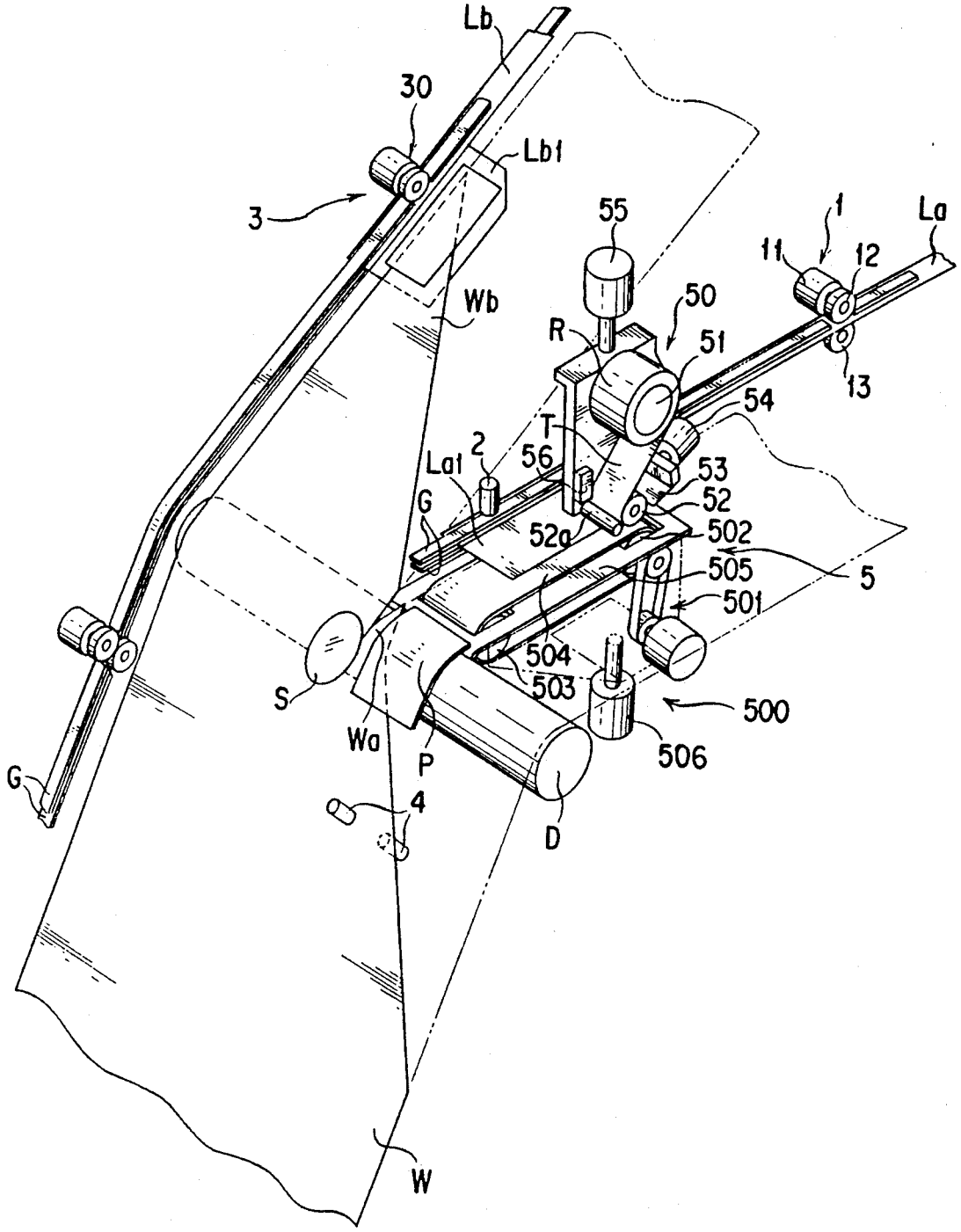
FIG. 1 is a schematic, perspective view showing one embodiment of the present invention.
Figure 2:
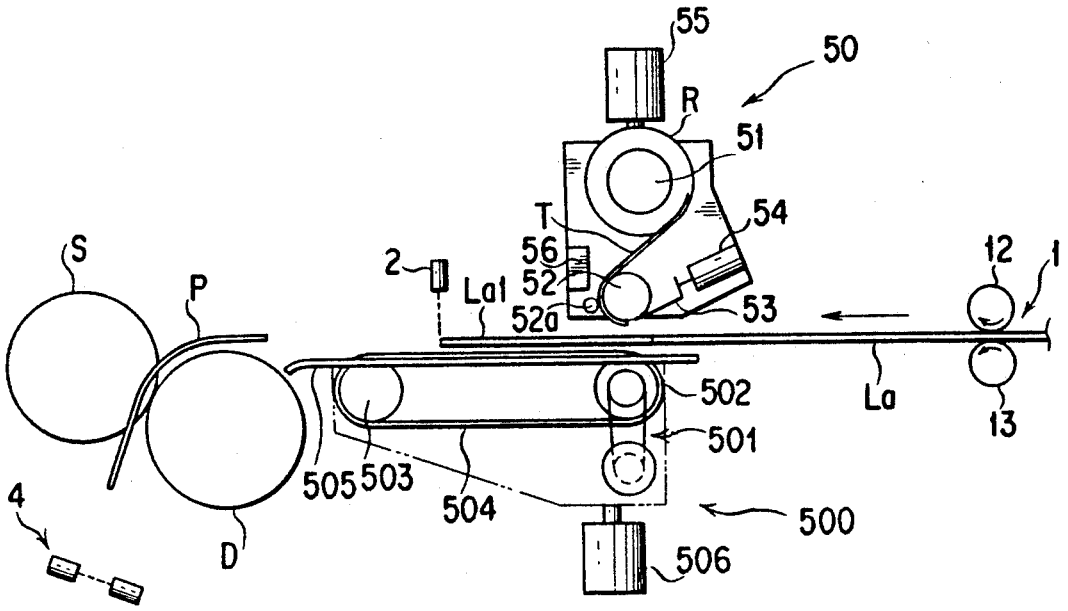
Figure 3:
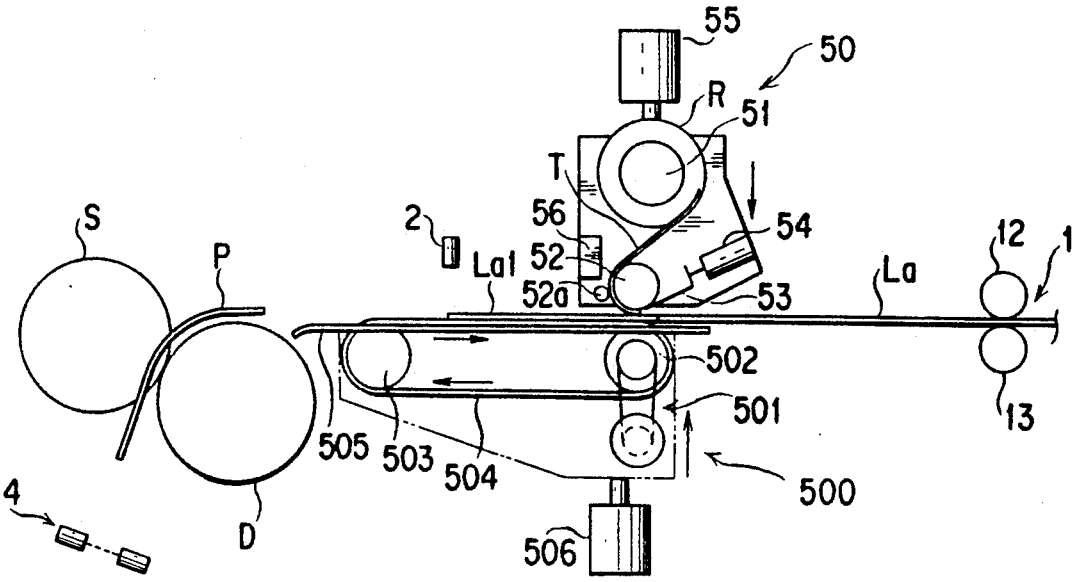
Figure 4:
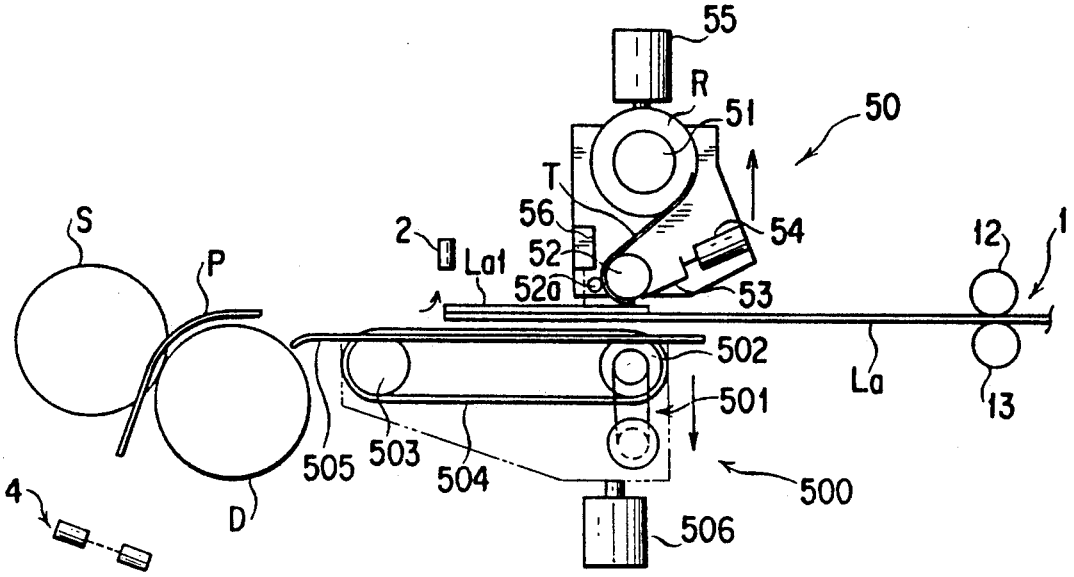
Figure 5:
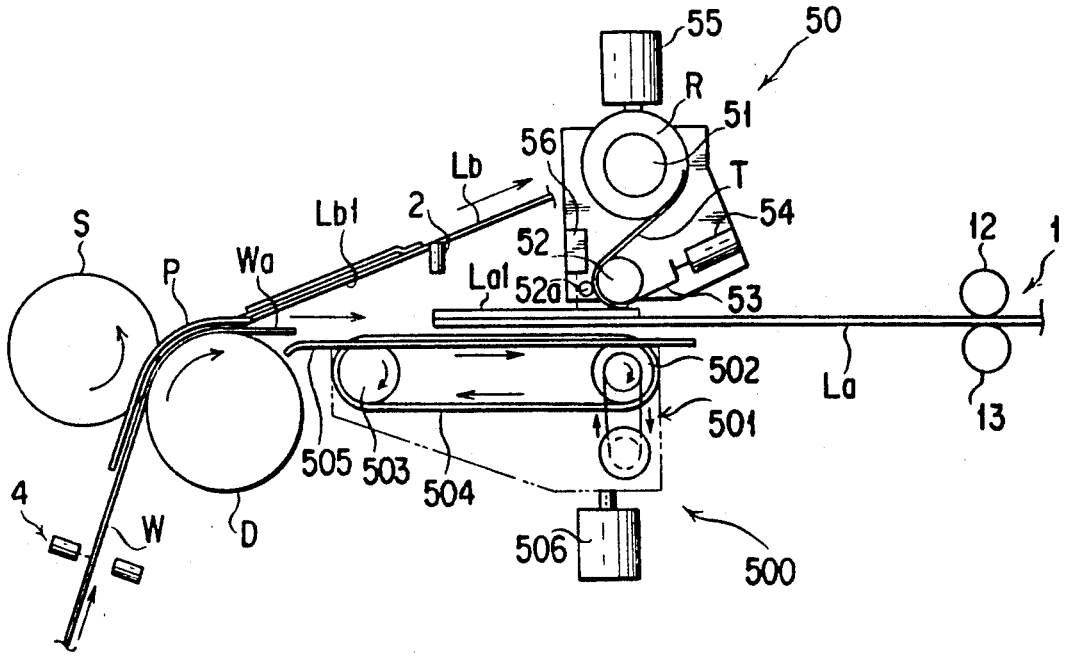
Figure 6:
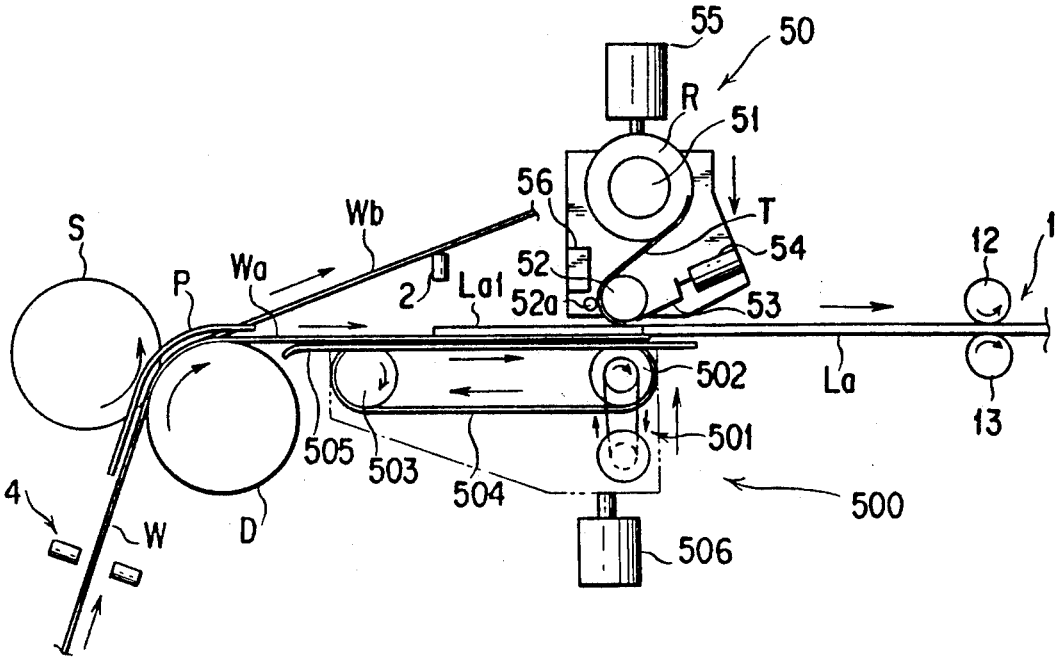
Figure 7:
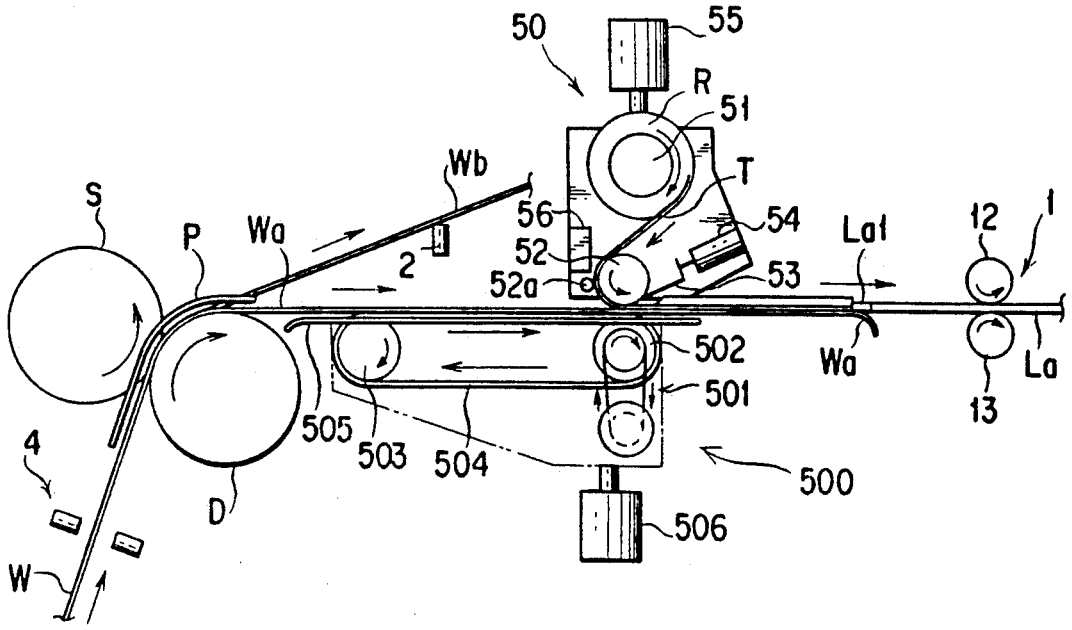

FIG. 1 is a schematic, perspective view showing one embodiment of the present invention. Referring to this drawing in detail, a paper web sticking device comprising a paper web threading member moving means 1, a paper web threading member detector means 2, a paper web moving means 3, a paper web detector means 4, and an adhesive material applying means 5 is provided in the vicinity of a slitter S, and a paper web W to be threaded along a paper web threading path is divided by the slitter into two portions, i.e., paper webs Wa and Wb. The divided paper web Wa which is rendered free by the division is stuck through the above-mentioned paper web sticking device to a paper web threading member La, which threads the divided paper web Wa through a paper web threading path, at a predetermined position on the downstream side of the slitter S. Further, it is to be noted that the "downstream side" of the paper web threading path is meant by the "right side" in the drawings.

A single or a plurality of paper web threading member moving means 1, each comprising a drive unit 11, a drive roller 12, and an auxiliary roller 13 are provided along guide members G, G, so that the paper web threading member La held by the drive roller 12 and the auxiliary roller 13 can be driven by the drive roller 12, thereby moving the paper web threading member La along a predetermined path between the above-mentioned predetermined position on the downstream side of the slitter S and the most downstream position of the path. In FIG. 1, a single paper web threading member moving means 1 is shown.

The paper web threading member detector means 2 is provided on the upstream side of the above-mentioned predetermined position, and is adapted to detect a paper web engaging member La1 for sticking the divided paper web Wa, which is provided on one end side of the paper web threading member La adapted to be moved along the above-mentioned predetermined path, and then output a detection signal.

The paper web moving means 3 is adapted to move the divided paper web Wa towards the above-mentioned predetermined position, and is a means for threading the paper web W through the path, which is provided for moving the divided paper web Wa towards the predetermined position by continuously threading the divided paper web Wb which is integrally connected with the other divided paper web Wa by the paper web W on the upstream side of the slitter S. This paper web moving means 3 comprises a paper web threading member Lb and a paper web threading member moving mechanism 30. Further, the paper web threading member moving mechanism 30 has the same construction as the above-mentioned paper web threading member moving means 1.

The paper web detector means 4 is adapted to detect the leading end of the paper web W passing through the paper web threading path and actuate a timer, not shown, which measures the time taken until the divided paper web Wa is moved by the paper web moving means 3 to a position where it may overlap fully the above-mentioned paper web engaging member La1, and then outputs a signal.

The adhesive material applying means 5 consists of an adhesive material supply mechanism 50 and a pressing mechanism 500. The adhesive material supply mechanism 50 comprises an adhesive material mounting portion 51 provided on one side facing the above-mentioned predetermined position, an adhesive material holding roller 52, a guide roller 52*a* located opposite to the roller 52, a cutter 53, a pneumatic or hydraulic cylinder 54 for driving the cutter 53, and a pneumatic or hydraulic cylinder 55 for moving these component parts all together towards and away from the predetermined position. Whilst, the pressing mechanism 500 comprises a drive unit 501 provided on the other side facing the predetermined position and opposite to the adhesive material supply mechanism 50, a drive roller 502, an auxiliary roller 503, an endless belt 504 wound round the drive roller 502 and the auxiliary roller 503, and a guide top 505. The pressing mechanism 500 serves to assist the paper web moving means 3 in moving the divided paper web Wa, and also has a pneumatic or hydraulic cylinder 506 for moving the drive unit 501, the drive roller 502, the auxiliary roller 503, the endless belt 504 and the guide top 505 all together towards and away from the predetermined position. Thus, by advancing the adhesive material supply mechanism 50 and the pressing mechanism 500 all together to the predetermined position, the paper web engaging member La1 and/or the divided paper web Wa located at the predetermined position are (is) pressed between the adhesive material holding roller 52, round which an adhesive material T is partially wound, and the endless belt 504 wound round the drive roller 502. Further, the adhesive material supply mechanism 50 comprises a detector unit 56 adapted to detect the paper web engaging member La1 which stands by with the adhesive material T such as, for example, an adhesive tape or the like applied thereto.

Further, in the drawings, reference character D denotes a drag roller, and P a guide plate for the divided paper web Wa.

The operation of the above-mentioned arrangement will be described below with reference to FIGS. 2 to 9. In FIGS. 2 to 9, the paper web W, the divided paper webs Wa and Wb, the paper web threading members La and Lb, the paper web engaging members La1 and Lb1, and the adhesive material T, etc are shown thicker than the actual thicknesses thereof.

First of all, the driving unit 11 of the paper web threading member moving means 1 is actuated to rotate the drive roller 12 in a direction shown by arrow to thereby move the paper web threading member La held by and between the drive roller 12 and the auxiliary roller 13 to the predetermined position on the downstream side of the slitter S where the paper web threading member La is stuck to the divided paper web Wa. Whereupon, the paper web threading member detector means 2 provided on the upstream side of the predetermined position will detect the paper web engaging member La1 secured to the paper web threading member La which has been moved to the upstream side end and output a detection signal, which stops the drive unit 11 of the paper web threading member moving means 1, thereby stopping the drive roller 12 to stop the movement of the paper web threading member La. Further, the adhesive material applying means 5 should desirably be arranged, as shown in FIG. 1, such that when the paper web threading member La is stopped, the free side edge of the paper web engaging member La2 is located somewhat inner than one side edge of the adhesive material or tape T held by and between the adhesive material holding roller 52 and the guide roller 52*a*. (Refer to FIG. 2)

When the movement of the paper web threading member La has been stopped, the respective rods of the pneumatic or hydraulic cylinders 55 and 506 are extended to move the adhesive material supply mechanism 50 and the pressing mechanism 500 to the predetermined position so that the paper web engaging member La1 located at the predetermined fixed position is pressed between the adhesive material holding roller 52, round which the adhesive material T is partially wound, and the endless belt 504 wound round the drive roller 502, thereby pressing the adhesive surface at one end of the adhesive material T held by and between the adhesive material holding roller 52 and the roller 52*a* against the paper web engaging member La1 to stick the adhesive side to the latter. Further, at that time, the detector unit 56 will detect the paper web engaging member La1 which has drawn near due to the advancement of the adhesive material supply mechanism 50. The pressing of the adhesive side of the adhesive material T against the paper web engaging side La1 is conducted for a sufficient time, for example, one to a few seconds to apply the adhesive material T onto the paper web engaging member La1. If, prior to the above-mentioned pressing, the drive unit 501 is actuated to rotate the endless belt 504 in a direction shown by arrow in FIG. 3 through the drive roller 502, the one end of the adhesive material T is guided by the endless belt 504 to the downstream leading end of the paper web engaging member La1, thereby ensuring that the adhesive side is always located in opposition to the paper web engaging member La1.

When the paper engaging member La1 has been pressed between the drive roller 502 and the endless belt 504, the respective rods of the pneumatic or hydraulic cylinders 55 and 506 are retracted so as to return the adhesive material supply mechanism 50 and the pressing mechanisms 500 to their original positions. With this return movement, the paper web engaging member La1 onto which the adhesive material R is applied will be displaced by the movement of the adhesive material supply mechanism 50 while it is being subjected to an elastic deformation, and biased to the side of the adhesive material supply mechanism 50. Further, by continuous detection of the biased paper web engaging member La1 by means of the detector unit 56, it is possible to confirm that the adhesive material T is applied securely onto the paper web engaging member La1 and maintained in this condition. After the above-mentioned adhesive material supply mechanism 50 has been returned to its original position, if the detection of the paper web engaging member La1 by the detector unit 56 is interrupted, then an alarm is given by a suitable alarming device, not shown, to inform the operator concerned that the adhesive material T is applied incompletely to the paper web engaging member La1. (Refer to FIG. 4)

When the paper web W passes through the slitter S while it pulled by another paper web threading member Lb, it is divided by the slitter S into two parts, i.e., paper webs Wa and Wb, and when the divided paper web Wb is pulled continuously by the paper web threading member Lb, the divided paper web Wa is moved towards the predetermined position where it is stuck to the paper web threading member La1 so that it may overlap the side of the paper web engaging member La1 reverse to the side thereof onto which the adhesive material T is applied. If, during this movement, the drive unit 501 is actuated, the endless belt 504 is rotated through the drive roller 502 in a direction shown by arrows in FIG. 5, thereby promoting the movement of the divided paper web Wa to the predetermined position. Further, the guide plate 7 is effective for changing the direction of movement of the divided paper web Wa. On the other hand, the paper web W is detected by the paper web detector means 4 on the upstream side of the slitter S, and the paper web detector means 4 then outputs a detection signal, thereby a timer, not shown, is actuated to measure the time taken until the divided paper web Wa is moved to the predetermined position.

When the divided paper web Wa has been moved to the predetermined position and the above-mentioned timer, not shown, has measured the above-mentioned time, the time will output a signal indicative of the completion of measurement, thereby causing extension of the respective rods of the pneumatic or hydraulic cylinders 55 and 506 so as to advance the adhesive material supply mechanism 50 and the pressing mechanism 500 to the predetermined position. As a result, the paper web engaging member La1 and the divided paper web Wa are pressed between the adhesive material holding roller 52, round which the adhesive material T is partially wound, and the endless belt 504 wound round the drive roller 502. When the drive unit 11 of the paper web threading member moving means 1 is actuated in synchronism with the above-mentioned pressing operation, the drive roller 12 is rotated in a direction shown by arrow in FIG. 6 to move the paper web threading member La, in cooperation with the auxiliary roller 13, towards the downstream side at substantially the same speed as that of the divided paper web Wa. Further, at that time, a timer, not shown, for measuring the above-mentioned preset time for the pressing operation conducted by the adhesive material supply mechanism 50 and the pressing mechanism 500 is actuated. By the above-mentioned pressing operation, the adhesive surface of the adhesive material T located outer than the free side edge of the paper edge engaging member La1 is applied onto the divided paper web Wa. And, with movement of the paper web threading member La, the divided paper web Wa is entrained with it. Further, by continued rotation of the endless belt 504 by the drive unit 501 in a direction shown by arrows in FIG. 6, the movement of the divided paper web Wa which is entrained by the movement of the paper web threading member La is promoted.

With the continued movement of the paper web threading member La in the above-mentioned condition, the succeeding portion of the adhesive material T is drawn out from the adhesive material roll R mounted on the adhesive material mounting portion 51 onto the peripheral surface of the adhesive material holding roller 52 so that the adhesive surface thereof may face the outside, and is applied further, when passing through the pressing zone, onto the divided paper web Wa, which is entrained by the movement of the paper web threading member La, by a predetermined length in the longitudinal direction thereof. (Refer to FIG. 7)

Figure 8:
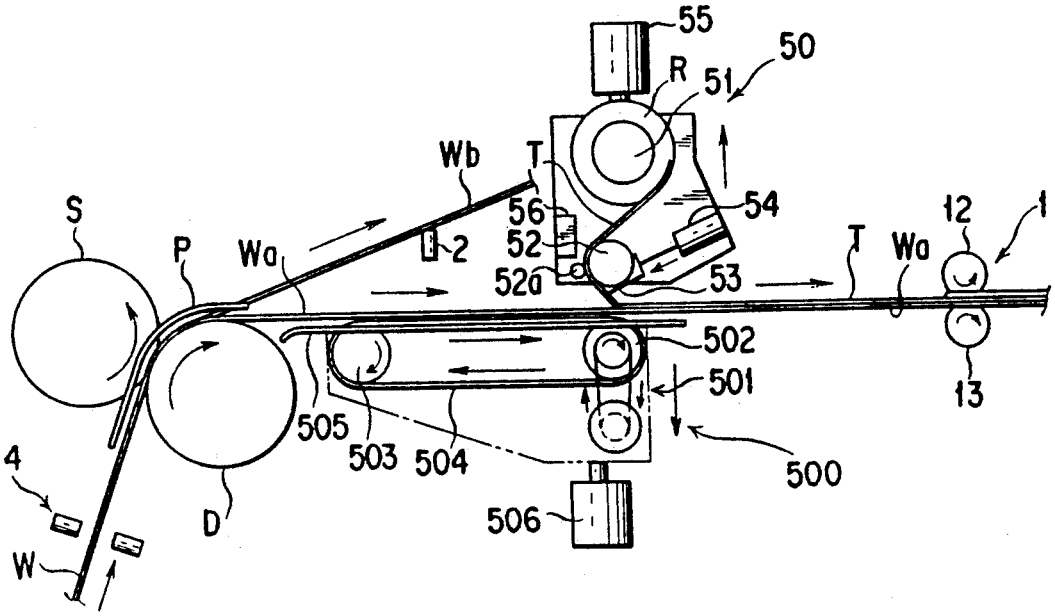
Figure 9:
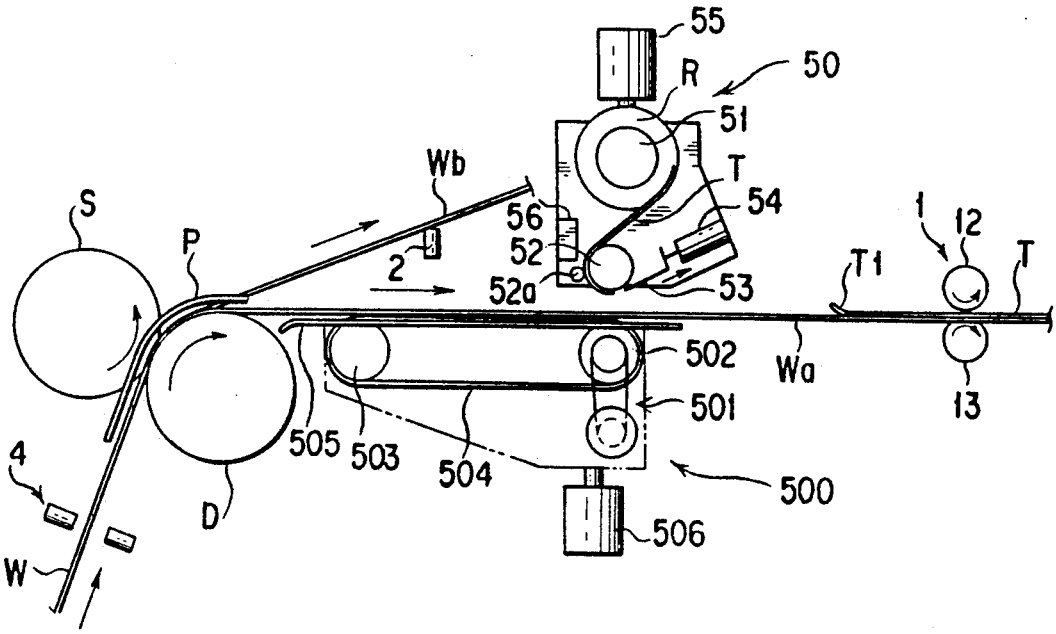

When the above-mentioned timer, not shown, for measuring the above-mentioned preset time for pressing against the paper web engaging member La1 and the divided paper web Wa has outputted a signal indicative of the completion of measurement of the above-mentioned time, the respective rods of the pneumatic or hydraulic cylinders 55 and 506 are retracted so as to return the adhesive material supply mechanism 50 and the pressing mechanism 500 to their original positions, and also a rod of a hydraulic cylinder 54 is extended to advance a cutter 53, thereby cutting the adhesive material T which is stretched between the adhesive material holding roller 52 and the divided paper web Wa by the return movement of the adhesive material supply mechanism 50 (Refer to FIG. 8)

Upon completion of the cutting of the adhesive material T, the rod of the hydraulic cylinder 54 is retracted to return the cutter 53 to its original position. With this return movement of the cutter 53, one end of the adhesive material which is newly formed by the cutting is drawn onto the outer peripheral surface of the adhesive material holding roller 52. Whilst, with the progress of threading of the divided paper web Wa along the relevant path, the tail end T1 of the adhesive material T stuck to the divided paper web Wa is depressed by a guide roller, not shown, located on the downstream side so that it is applied onto the divided paper web Wa. And, the drive unit 501 is stopped, thereby stopping the rotation of the endless belt 504. Further, the arrangement may be made such that, after passage of the paper web threading member La, the drive unit 11 of the paper web threading member moving means 1 is stopped, thereby stopping the rotation of the drive roller 12. (Refer to FIG. 9)

By the above-mentioned operations, the sticking of the divided paper web Wa to the paper web threading member La is completed.

The present invention is not to be limited to the above-mentioned embodiment, and each of the means constituting the paper web sticking device may be of a suitable construction. Further, the paper web sticking device may be installed on a paper web supply unit located at the starting point of threading of the paper web W through the path. And, the arrangement may be made such that the paper web W is stuck to the paper web engaging member Lb1 secured to the paper web threading member Lb. Further, in this case, it is a matter of course that each of the means constituting the paper web sticking device, for example, the paper web moving means should be constructed properly so that it may handle the paper web W. What is essential is that the present invention covers all modifications and changes in the design thereof which do not depart from the scope of the appended claims.

What is claimed is:

1. A method of connecting a paper web threading member with a paper web, comprising the steps of applying one end of an adhesive material to a paper web engaging member connected to one end of the paper web threading member, and then letting them stand by in that condition, moving the paper web by a predetermined distance along a paper web threading path towards the downstream side thereof so that it may overlap the paper web engaging member which stands by, and moving again the paper web engaging member and the paper web together along the paper web threading path towards the downstream side thereof while pressing against both of them so that the succeeding portion of said adhesive material may be applied onto the paper web engaging member and the paper web after the paper web has overlapped the paper web engaging member which stands by.

2. An apparatus for connecting a paper web threading member with a paper web, comprising:

a paper web threading member connected to one end of the paper web threading member;

a paper web threading member moving means for moving the paper web threading member to a predetermined position along a predetermined path at which the paper web engaging member connected to the one end of the paper web threading member is stuck to the paper web and for moving the paper web threading member from the predetermined position along the predetermined path;

a paper web threading member detector means disposed on an upstream side of the predetermined position for detecting whether the paper web threading member is located at said predetermined position or has been moved away therefrom, and threading member detector means then outputting a detection signal;

a paper web moving means disposed in association with the predetermined path of the paper web for moving the paper web;

a paper web detector means for detecting the movement of the paper web to said predetermined position at which the paper web is stuck to the paper web engaging member, the paper web detector means then outputting a detection signal; and an adhesive material applying means provided in the vicinity of said predetermined position and above the paper web path for applying an adhesive material onto said paper web engaging member and said paper web from an upper side thereof to connect the paper web threading member located at said predetermined position with the paper web.

3. An apparatus according to claim 2, wherein said adhesive material applying means applies one end of the adhesive material to the paper web engaging member at a first stage of the connection of the paper web.

4. An apparatus according to claim 2, wherein said adhesive material applying means comprises an adhesive material supply mechanism and a pressing mechanism.

5. An apparatus according to claim 4, wherein said adhesive material supply mechanism comprises an adhesive material mounting portion provided on one side facing the predetermined position, an adhesive material holding roller, a guide roller located opposite to the holding roller, a cutter, a first fluid cylinder for driving the cutter and a second fluid cylinder for moving the mounting portion, holding roller, guide roller, cutter and first fluid cylinder all together towards and away from the predetermined position.

6. An apparatus according to claim 5, wherein said pressing mechanism comprises a drive unit provided on the other side facing the predetermined position and opposite to the adhesive material supply mechanism, a drive roller, an auxiliary roller, an endless belt would round the drive roller, and a fluid cylinder for moving the drive unit, the drive roller, the auxiliary roller, the endless belt and a guide top all together towards and away from the predetermined position.

* * * * *